US006140029A

United States Patent [19]

Clark et al.

[11] Patent Number: 6,140,029

[45] Date of Patent: Oct. 31, 2000

[54] COLOR PHOTOGRAPHIC ELEMENT CONTAINING ELEMENTAL SILVER AND NITROGEN HETEROCYCLE IN A NON-LIGHT SENSITIVE LAYER

[75] Inventors: Bernard A. Clark, Berkshire; Jane S. Boff; Philip A. Allway, both of Herts, all of United Kingdom; Louis E. Friedrich, Rochester; Stephen P. Singer, Spencerport, both of N.Y.

[73] Assignee: Eastman Kodak Company, Rochester, N.Y.

[21] Appl. No.: 09/410,254

[22] Filed: Sep. 30, 1999

Related U.S. Application Data

[63] Continuation-in-part of application No. 09/186,844, Nov. 5, 1998, abandoned, which is a continuation-in-part of application No. 09/014,855, Jan. 29, 1998, abandoned.

[51] Int. Cl.[7] ..... G03C 7/392; G03C 1/825

[52] U.S. Cl. ..... 430/506; 430/507; 430/510; 430/614; 430/615

[58] Field of Search ..... 430/510, 507, 430/614, 615, 233, 506

[56] References Cited

U.S. PATENT DOCUMENTS

| | | | |
|---|---|---|---|
| 3,671,255 | 6/1972 | Haga et al. . | |
| 4,366,231 | 12/1982 | Mayer et al. | 430/510 |
| 4,720,451 | 1/1988 | Shuto et al. | 430/613 |
| 4,886,738 | 12/1989 | Deguchi et al. | 430/510 |
| 4,920,043 | 4/1990 | Ohashi et al. | 430/64 |
| 5,081,008 | 1/1992 | Deguchi | 430/510 |
| 5,275,931 | 1/1994 | Saitou et al. | 430/609 |
| 5,508,154 | 4/1996 | Mizukawa et al. | 430/614 |
| 5,716,768 | 2/1998 | Maruyama et al. | 430/510 |
| 5,821,042 | 10/1998 | Massirio et al. | 430/510 |
| 6,043,013 | 3/2000 | Burns et al. | 430/510 |

FOREIGN PATENT DOCUMENTS

| | | |
|---|---|---|
| 0369486 | 12/1997 | European Pat. Off. . |
| 19507913 | 4/1997 | Germany . |
| 60-20390 | 8/1977 | Japan . |
| 57-125939 | 8/1982 | Japan . |
| 59-159162 | 9/1984 | Japan . |
| 60-194443 | 10/1985 | Japan . |
| 63-193147 | 8/1988 | Japan . |
| 60-217358 | 10/1988 | Japan . |
| 1-137255 | 5/1989 | Japan . |
| 4-204937 | 7/1992 | Japan . |

*Primary Examiner*—Richard L. Schilling
*Attorney, Agent, or Firm*—Arthur E. Kluegel

[57] ABSTRACT

The invention provides a silver halide photographic element comprising a non-light sensitive layer containing elemental silver and a nitrogen heterocycle compound having a ClogP of at least 4.5, which compound comprises a ring system of one or more fused rings containing at least one —N—H bond, the ring system comprising a total of at least three nitrogen ring members and the associated bonds; provided that the compound does not contain an —SH group or >C═S group and does not react with an oxidized developer.

25 Claims, No Drawings

COLOR PHOTOGRAPHIC ELEMENT CONTAINING ELEMENTAL SILVER AND NITROGEN HETEROCYCLE IN A NON-LIGHT SENSITIVE LAYER

CROSS-REFERENCE TO RELATED APPLICATIONS

This application is a continuation-in-part of U.S. Ser. No. 09/186,844 filed Nov. 5, 1998, now abandoned which is in turn a continuation-in-part of U.S. Ser. No. 09/014,855 filed Jan. 29, 1998, now abandoned. The contents of these prior applications is incorporated herein by reference.

FIELD OF THE INVENTION

This invention relates to a color photographic element containing elemental silver and a certain nitrogen heterocycle compound in a non-light sensitive layer.

BACKGROUND OF THE INVENTION

It has long been an object of silver halide-based color photographic materials to create an image of an object in an accurate manner, both in terms of color and image structure characteristics such as graininess and sharpness. It is well known that the perceived sharpness of photographic images can be degraded through halation effects; that is, the reflection and subsequent diffusion of light within the light capturing element; in particular, reflection from the support. It is well known to use antihalation layers between the support and the sensitized layers in films to reduce light reflection. To be effective, an antihalation layer contains materials that absorb light and prevent reflection. In general, it is highly desirable for the light absorbing materials to be totally removed from the film element (or otherwise made colorless) after development in order to avoid increased background density. One well known type of light absorbing material suitable for use in antihalation layers is colloidal or finely divided elemental or metallic silver (also referred to as 'grey' silver). This type of silver metal is in a filamentary form and, is such form, absorbs light across the visible spectrum appearing grey or black. It is generally easily removed from the film element by the normal bleaching and fixing steps used to remove imaging silver from the element. This silver metal is not light sensitive and does not contribute to image formation. For references, see T. H. James, The Theory of the Photographic Process, $4^{th}$ Edition, p. 579, U.S. Pat. No. 3,434,839, JP 09-067122A2 and Y. J. Zahng et al, Chin. Chem. Lett. 7(7), 687–690(1996).

Another use of colloidal or finely divided elemental or metallic silver is as a blue light absorbing filter. This form, commonly referred to as Carey-Lea silver, differs from 'grey' silver by being spherical in form. For references, see F. Evva, J. Signalaufzeichnungmaterialien, 4(1), 43–60 (1976) and G. Frens, Kolloid-Z.Z. Polym, 233(1–2), 922–9 (1969). This material is generally located in a non-imaging layer (commonly referred to as a yellow filter layer) farther away from the exposing source than or "underneath" the blue light sensitive emulsion layer. The function of this layer is to absorb any blue light not captured by the blue sensitized layers, thus avoiding undesired exposure by blue light of the underlying green and red sensitized emulsion layers, which retain some inherent sensitivity to blue light.

A problem associated with the use of elemental silver in both antihalation and yellow filter layers is an undesired increase in fog in nearby imaging layers. During development, silver ions are released and/or made soluble from the imaging layer. These silver ions can migrate to a non-light sensitive layer where the elemental silver is present. The silver can serve as nuclei for the reduction of the migrating silver ions to silver metal with concurrent oxidation of developer to oxidized developer. This process is called solution physical development (for references, see T. H. James, ibid., Chapter 13) and is non-imagewise. The oxidized developer can diffuse out of the antihalation layer and back into the nearby imaging layer where it can react with the couplers present and form dye in a non-imagewise fashion. This process is often highly process sensitive and can lead to variations in Dmin during photofinishing.

Another problem with the use of elemental silver in non-imaging layers is that these layers can absorb inhibitor fragments and other silver absorbing materials. This results in lower effective concentrations of the free species in the imaging layers. Restricted diffusion of such species through the layer containing the elemental silver can also occur.

It is known that the solution physical development involving elemental silver can be modified by the use of additives. For example, GB 2280276 A1, DE 1949418, East German Patent 2006 91/6 and Japanese Patent Application (Kokai) JP 3-14 138639A2 all describe various classes of materials that are useful for controlling the properties of elemental silver. In particular, JP 6-347940 describes among others, the use of bentrotriazoles and other nitrogen heterocycles. However, in all of these references, the materials are water soluble and, of all the examples shown, the maximum ClogP is 3.79. Such water soluble materials can undesirably diffuse to imaging layers where they can cause inhibition of development and loss of sensitivity to light.

Solution physical development can be promoted by materials that form soluble silver salts. In particular, materials that release low molecular weight water solubilized thiols, which are used as bleach accelerators, can increase the amount of solution physical development. Couplers that release such thiols are known are bleach accelerator releasing couplers; for examples, see EP 193389, U.S. Pat. No. 4,861,701; U.S. Pat. No. 4,959,299; U.S. Pat. No. 4,912,024; U.S. Pat. No. 5,300,406 and U.S. Pat. No. 5,358,828. It is also possible to release the same bleach accelerators from materials other than couplers by imagewise means that do not involve direct coupling with oxidized developer; for example, see U.S. Pat. No. 4,684,604 or by non-imagewise means, for examples, see U.S. Pat. No. 4,923,784, U.S. Pat. No. 4,865,956 and U.S. Pat. No. 5,019,492. Thus, increases in Dmin in imaging layers near to non-imaging layers which contain collodial silver are particularly problematic when bleach accelerators are also present.

Substituted triazoles, including 1,2,3-triazoles, 1,2,4-triazoles (including tetraazaindenes) and benzotriazoles, are commonly known in the art as inhibitor fragments and as antifoggants; for example, as in U.S. Pat. No. 3,671,255. As inhibitor fragments, they are attached to a coupling moiety through a nitrogen atom and do not interact with silver until coupling occurs and the nitrogen atom is freed. As antifoggants, these materials are added directly to silver emulsions before coating of the film or added directly to the developer solutions. JP-60-29390 describes the use of ballasted benzotriazoles for use as inhibitor fragments attached to couplers to form Development Inhibitor Releasing Couplers (DIRs). U.S. Pat. Nos. 5,275,931; 4,920,043; and 4,720,451, and Japanese Patent Applications (Kokai) JP-63-193147, JP-60-217358, JP-59-159162, JP-57-125939, JP-4-204937, JP-1-137255 all describe the use of various triazole and benzotriazole derivatives for use as antifoggants. U.S. Pat. No. 5,508,154 describes the use of bicyclic heterocycles that contain a minimum of 4 nitrogen atoms as antifoggants in systems that contain inhibitor releasing couplers. DE 1 95 07913 A1 describes the use of ballasted benzimidiazoles to improve granularity particularly with certain pyrazolone image couplers. EP 0 369 486 B1 describes the use of various heterocyclic thiols with fine silver chloride emulsions to remove inhibiting species. U.S. Pat. No. 4,871,658 describes the use of tetrazoles with silver iodobromide emulsions to decrease fog. All of these materials are used for control of imaging silver halide emulsions in light sensitive layers and are not used in non-imaging layers.

U.S. Pat. No. 5,464,733 describes the use of an interlayer between an antihalation layer containing colloidal silver and imaging layers containing bleach accelerators to control Dmin. In general, the Dmin in any imaging layer directly adjacent to a layer containing elemental silver can be reduced by placing a non-silver containing interlayer between them. However, this adds to the overall number of layers present in the film and increases film thickness and manufacturing complexity.

One particular problem is high red Dmin whenever a red sensitized layer is directly adjacent to an antihalation layer that contains black colloidal silver. This is further aggravated whenever there are multiple red sensitized layers of different overall degree of light sensitivity present. However, multiple layers are desirable for reducing granularity through more effective use of silver centers. For this reason, the red record is commonly divided into either two layers of different red sensitivity (for example, see U.S. Pat. No. 5,464,733) or three layers (for example, see U.S. Pat. No. 4,886,738). In each of the above examples, an interlayer between the least sensitive (bottom-most) red record and the antihalation layer is used.

Improvements in granularity can be obtained by dividing a color record into four layers of different degree of light sensitivity, for example as described in JP 60-28652 and JP 60-03628. However, in this case, while dividing a red color record into four separate layers can allow for improved granularity, it adds to the number of layers that must be coated and is constrained by the additional need to have an interlayer between an antihalation layer containing elemental silver layer and the nearest imaging layer. This also applies to blue and green color records which can be adjacent to a non-imaging yellow filter layer which contains Carey-Lea silver.

A problem to be solved is to provide a photographic element containing a non-light sensitive layer containing elemental silver which has a reduced tendency to increase the Dmin of nearby light sensitive layers. An additional problem to be solved is to minimize the number of layers necessary in a photographic element to meet Dmin requirements, said element having non-imaging layers that contain elemental silver.

SUMMARY OF THE INVENTION

The invention provides a silver halide photographic element comprising a non-light sensitive layer containing elemental silver and a nitrogen heterocycle compound having a ClogP of at least 4.5, which compound comprises a ring system of one or more fused rings containing at least one —N—H bond, the ring system comprising a total of at least three nitrogen ring members and the associated bonds; provided that the compound does not contain an —SH group or >C═S group and does not react with an oxidized developer.

The invention provides a reduction in Dmin values of the imaging layers.

DETAILED DESCRIPTION OF THE INVENTION

The photographic element of the present invention is generally as described in the Summary of the Invention. Typically, it relates to a light sensitive color photographic element with at least one red sensitive silver halide emulsion layer containing at least one non-diffusing cyan coupler, at least one green sensitive silver halide emulsion layer having at least one non-diffusing magenta coupler and at least one blue sensitive silver halide emulsion layer having at least one non-diffusing yellow coupler, and at least one non-light sensitive layer containing both a form of elemental silver metal and a nitrogen heterocycle in accordance with the invention.

Suitable nitrogen heterocycles for use in this invention comprise a ring system of one or more fused rings containing at least one —N—H bond, the ring system comprising a total of at least three nitrogen ring members and the associated bonds; the compound does not contain an —SH group or >C═S group and does not react with an oxidized developer. An example of such a compound is represented by Formula I:

Formula I

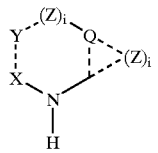

In Formula I, Q, X and Y may be any combination of nitrogen and carbon atoms necessary to complete a heterocyclic ring system with Z representing an optional series of nitrogen and carbon atoms with i =0 or 1 such that the heterocyclic ring system contains at least three nitrogen atoms in total. The bonds (shown as dotted lines) between the nitrogen and carbon atoms are single or double as necessary to complete the ring. Any carbon atom that is present in the ring may have a hydrogen atom or other substituent such as an alkyl group, a phenyl group, an ether group, a thioether group, a nitrogen group such as amino, aminocarbonyl or aminosulfonyl, an oxygen, a sulfoxide group, a sulfone group, a halide such as chloro or bromo, a cyano group, a nitro group, a carbonyl group such as keto, carboxylic acid, carboxylate ester or carbamoyl or such other substituent group as described generally hereafter. These substituents may be connected to others to form additional ring systems and benzo-, naptho- or hetero-rings may be annulated to the heterocyclic ring nucleus. Triazole rings and diazole rings fused to one or more further azole rings are conveniently employed. Some examples of the ring systems of Formula I of the invention are 1,2,3 triazoles, 1,2,4 triazoles, benzotriazoles, tetraazaindenes, pentaazaindenes, purines, tetrazoles and pyrazolotriazoles.

Free thiol groups (—SH) and thiocarbonyl groups (>C═S) are specifically excluded as substituents. At high levels, ballasted heterocyles with thiol or thiocarbonyl groups can form insoluble silver salts that cannot be removed from the film by the bleaching or fixing steps of the process. Retained silver salts are colored and result in degradation of color reproduction of the film.

The materials of Formula I are not couplers and do not react with oxidized developer. Such reaction would adversely affect color, image forming efficiency, etc.

An important feature of the heterocycles of Formula I is their oil/water partition coefficient. The oil/water partition coefficient can be calculated using the software program Medchem 3.54 to predict this value as ClogP (Calculated log partition coefficient). Medchem version 3.54 is a software program produced by the Medicinal Chemistry Project, Pomona College, Pomona Calif. It is believed that, in order to obtain the desired reduction of Dmin and fog in nearby imaging layers, the water solubility cannot be so low that the material is unable to interact effectively with the silver surface. Thus, it is preferred that the overall ClogP of the heterocycles of Formula I are not greater than 10.5 and most preferred that the ClogP is not greater than 10. It is also believed, however, that the water solubility cannot be so high that the material can diffuse away from the layer containing the elemental silver into adjacent imaging layers thereby causing a loss in light sensitivity. Thus, it is necessary that the ClogP of the heterocycle of Formula I be at least 4.5 or most preferably at least 5.5.

In general, the molar ratio of the heterocycle of Formula I to silver should be at least 0.1 mmole to mole of silver and more preferably, at least 1.0 mmole but less than 100 mmole and more preferably, less than 50 mmole.

The following are examples of heterocycles that are useful in this invention along with the corresponding ClogP values in parentheses:

H-A:
(7.78)

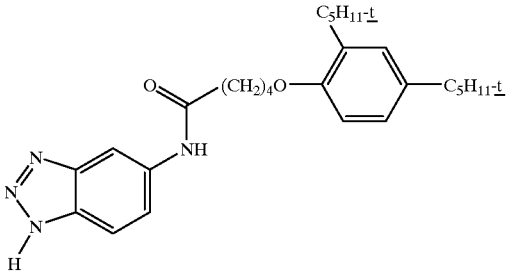

H-B:
(5.15)

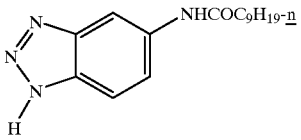

H-C:
(6.21)

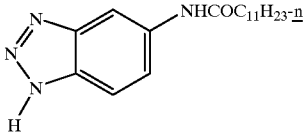

-continued

H-D:
(7.98)

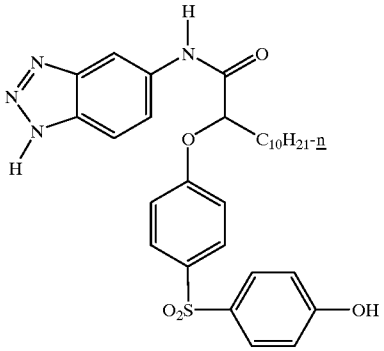

H-E:
(9.08)

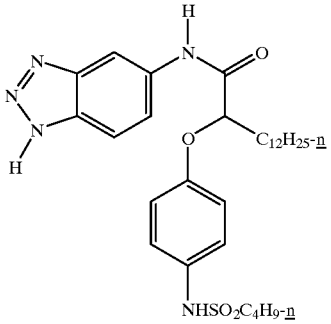

H-F:
(8.94)

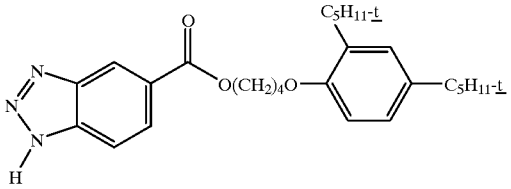

H-G:
(8.68)

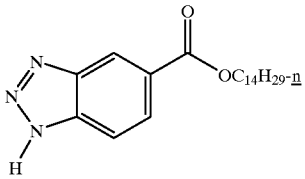

H-H:
(6.31)

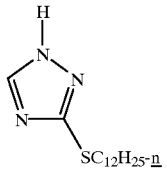

H-I:
(7.04)

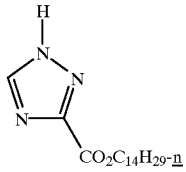

-continued
H-J:
(8.43)
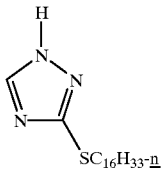
H-K:
(8.26)
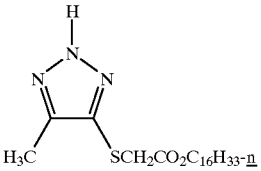
H-L:
(9.84)
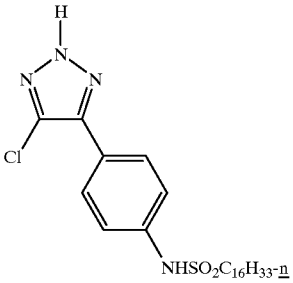
H-M:
(7.77)
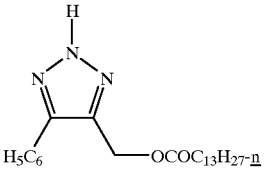
H-N:
(9.20)
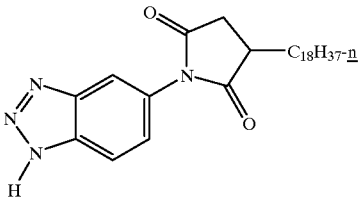
H-O:
(8.16)
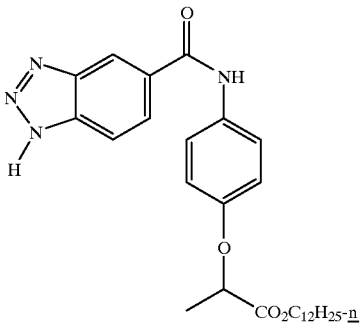
-continued
H-P:
(11.06)
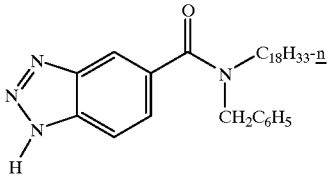
H-Q:
(12.96)
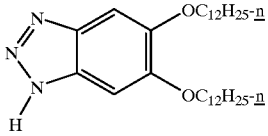
H-R:
(9.57)
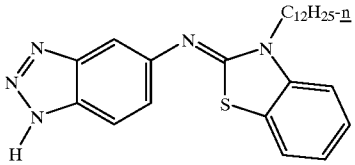
H-S:
(8.86)
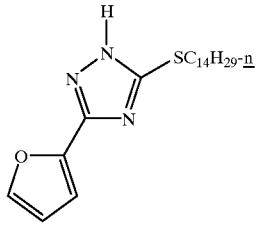
H-T:
(11.25)
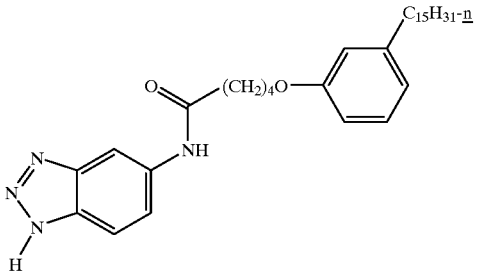
H-U:
(4.80)
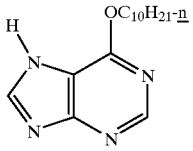
H-Y:
(5.02)
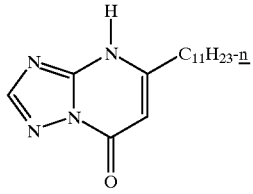

-continued

H-Z:
(5.82)

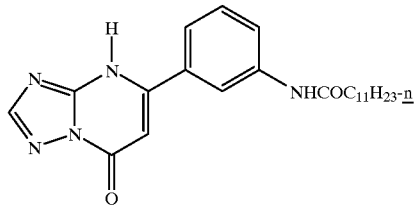

H-AA:
(5.25)

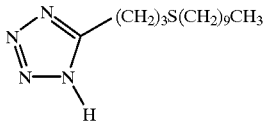

and

H-AB:
(6.33)

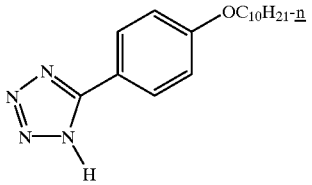

The heterocycles of the invention are conveniently employed with the compounds typically used as scavengers for oxidized developer. Such scavenger are described in Research Disclosure as described hereinafter and include, for example, phenolic and hydroquinone derivatives such as 2,4-di-t-octyl-hydroquinone.

The materials of the invention can be added to a solution containing silver before coating or be mixed with the silver just prior to or during coating. In either case, additional components like dyes, doctors, surfactants, hardeners and other materials that are typically present in such solutions may also be present at the same time. The materials of the invention are not water soluble and cannot be added directly to the solution. They may be added directly if dissolved in an organic water miscible solution such as methanol, acetone or the like or more preferably as a dispersion. A dispersion incorporates the material in a stable, finely divided state in a hydrophobic organic solvent that is stabilized by suitable surfactants and surface active agents usually in combination with a binder or matrix such as gelatin. The dispersion may contain one or more permanent coupler solvent that dissolves the material and maintains it in a liquid state. Some examples of suitable permanent coupler solvents are tricresylphosphate, N,N-diethyllauramide, N,N'-dibutyllauramide, p-dodecylphenol, dibutylpthalate, di-n-butyl sebacate, N-n-butylacetanilide, 9-octadec-en-1-ol, trioctylamine and 2-ethylhexylphosphate. The dispersion may require an auxiliary coupler solvent to initially dissolve the component but is removed afterwards, usually either by evaporation or by washing with additional water. Some examples of suitable auxiliary coupler solvents are ethyl acetate, cyclohexanone and 2-(2-butoxyethoxy)ethyl acetate. The dispersion may also be stabilized by addition of polymeric materials to form stable latexes. Examples of suitable polymers for this use generally contain water solubilizing groups or have regions of high hydrophilicity. Some examples of suitable dispersing agents or surfactants are Alkanol XC or saponin. The materials of the invention may also be dispersed as an admixture with another component of the system such as a dye or a oxidized developer scavenger so that both are present in the same oil droplet.

Throughout this specification, unless otherwise specifically stated, when a substituent group contains a substitutable hydrogen, it is intended to encompass not only the substituent's unsubstituted form, but also its form further substituted with any group or groups as herein mentioned, so long as the group does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy)butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl—N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl—N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl;

sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. It is essential that the invention materials are incorporated in a non-sensitized layer on a support to form part of a photographic element.

To control the migration of various components, it may be desirable to include a high molecular weight or polymeric backbone containing hydrophobic or "ballast" group in molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12*a* North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to Research Disclosure, September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dipersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 25 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777, and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58–172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching or fixing to improve the quality of the image. These bleach releasing materials may or may not be couplers as described in the background. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles benzisodiazoles. In a preferred embodiment, the inhibitor moiety or group is selected from the following formulas:

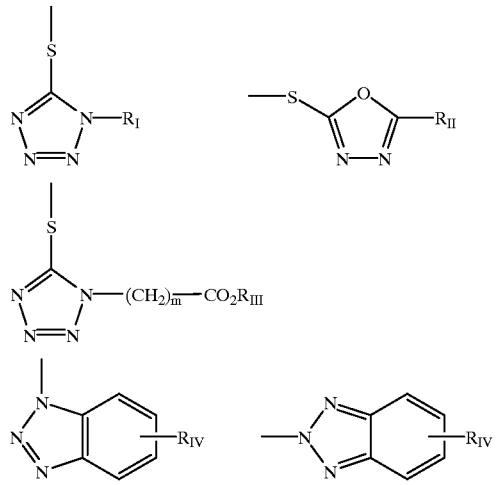

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —SRI; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

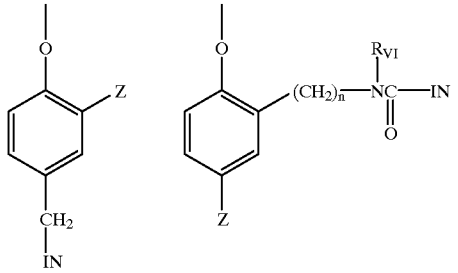

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Aside from the compound of Formula II of the invention, suitable developer inhibitor-releasing couplers that may be included in photographic light sensitive emulsion layer include, but are not limited to, the following:

D1

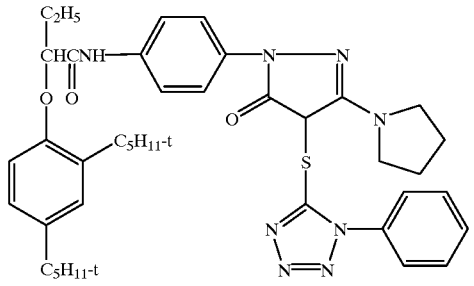

D2

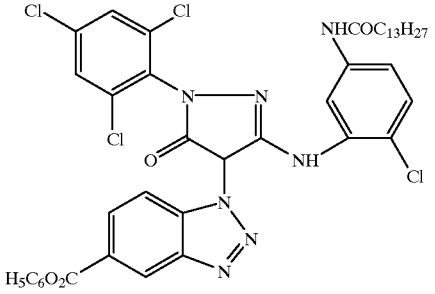

-continued

D3

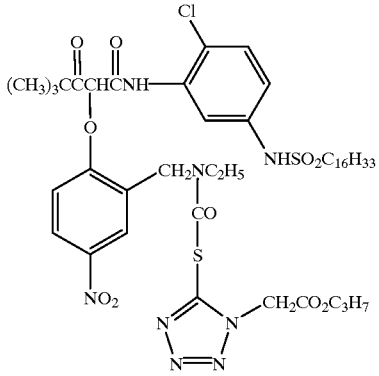

D4

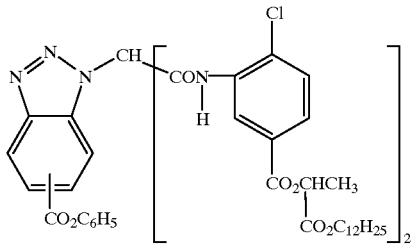

D5

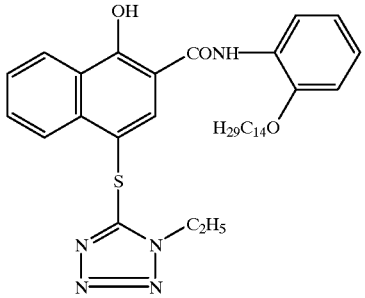

D6

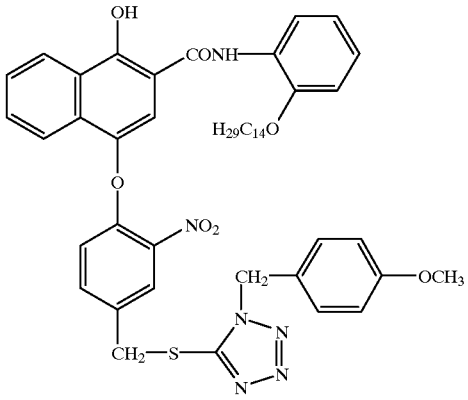

-continued
D7
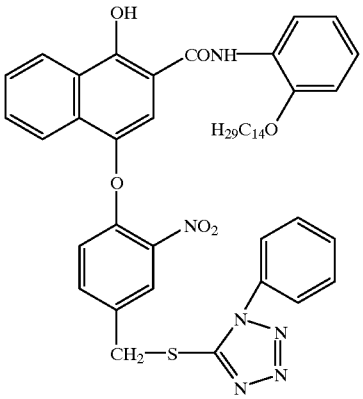
D8
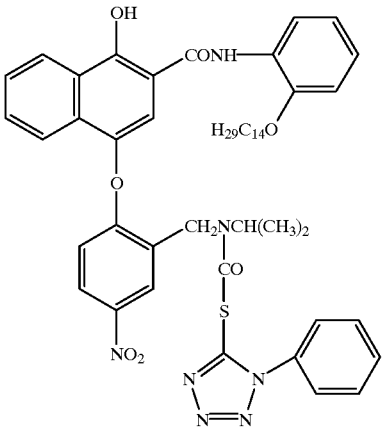
D9
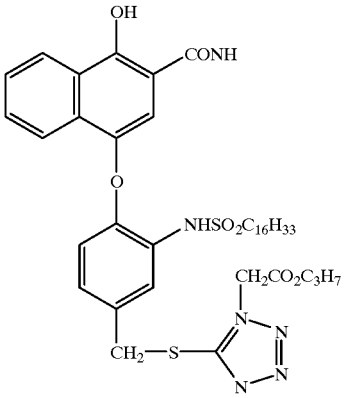
-continued
D10
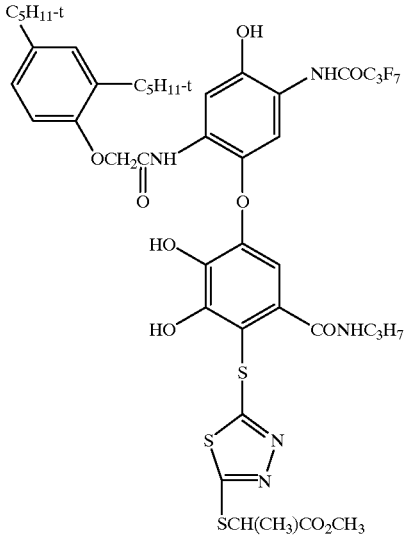
D11
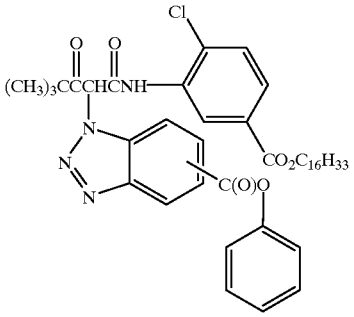
D12
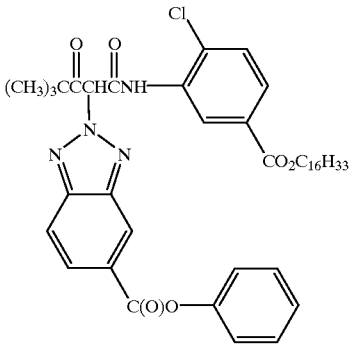

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.07 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire PO10 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. Tabular grain emulsions consisting predominantly of silver chloride are useful and are described, for example, in U.S. Pat. No. 5,310,635; 5,320,938; and 5,356,764.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Tabular grains are those having two parallel major crystal faces and having an aspect ratio of at least 2. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 10 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process. Alternatively, a direct positive emulsion can be employed to obtain a positive image.

The above emulsions are typically sold with instructions to process using the appropriate method such as the mentioned color negative (Kodak C-41) or reversal (Kodak E-6) process.

Preferred color developing agents are p-phenylenediamines such as:

4-amino—N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patent applications, patents and other publications referred to in this specification are incorporated herein by reference.

Synthesis

The synthesis of H-A is shown in the following Scheme I as follows:

Scheme I

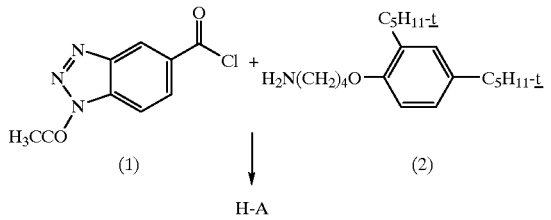

Synthesis of H-A: A stirred solution of Compound 1(11.2 g, 50 mmol) in tetrahydrofuran (75 ml) was cool ed to −7° C. A mixture of Compound 2 (15.0 g, 49 mmol) in tetrahydrofuran (50 ml) and pyridine (25 ml) was added to the stirred solution over 0.5 hour keeping the temperature −1° C. The reaction mixture was stirred at room temperature for 17 hours. The mixture was concentrated under reduced pressure and the residual oil was poured into a mixture of ice/water (500 ml) and concentrated hydrochloric acid (100 ml). The aqueous mixture was extracted with ethyl acetate (200 ml) and the extract dried over magnesium sulphate and concentrated under reduced pressure to give a gum. A solution of potassium hydroxide (2.8 g, 50 mmol) in methanol (20 ml) was added to a stirred solution of the gum dissolved in methanol (150 ml). After stirring at room temperature for 0.25 hour, the solution was poured into 3N hydrochloric acid (300 ml). The aqueous solution was extracted with ethyl acetate (2×150 ml) and the extract dried over magnesium sulphate and concentrated under reduced pressure. The crude material was purified by column chromatography eluting with 1:9 60-80 petroleum ether:ethyl acetate to give a glass. The glass was crystallized from ethyl acetate (100 ml)/60-80 petroleum ether (20 ml) to give a pale pink solid, 14.2 g (63%). Expected C, 71.96; H, 8.50; N, 12.44; Found C, 71.54; H, 8.35; N, 12.37%.

PHOTOGRAPHIC EXAMPLES A–D

A—Antihalation Layer

Bilayer photographic elements were prepared by coating the following layers on a cellulose triacetate film support (coverages are in g/m$^2$). Unless otherwise noted, all comparative and inventive compounds were dispersed in twice their own weight of N,N-dibutyllauramide:

Layer 1 (Antihalation Layer): Gelatin at 2.04, black colloidal silver at 0.135, UV-1 at 0.075 and UV-2 at 0.075. The inventive and comparative materials, when present, were added at 0.0081. ILS-1, when present, was added at 0.162.

Layer 2 (Cyan Layer): gelatin at 1.61, C-1 at 0.48, C-2 at 0.075, C-3 at 0.015 and 0.683 red sensitized AgIBr tabular emulsion.

Layer 3 (Overcoat): gelatin at 5.38 and 0.016 bis-vinylsulfonemethylether

The structures of the couplers and comparative materials used, along with the corresponding ClogP where appropriate, in the above format are as follows:

UV-1:

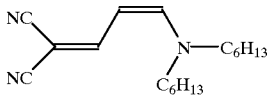

UV-2:

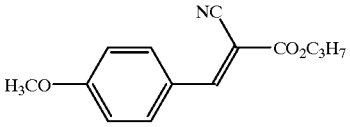

C-1:

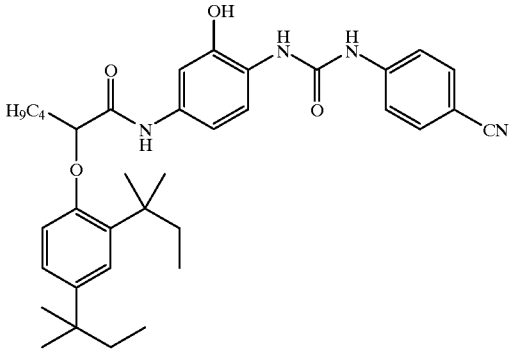

C-2:

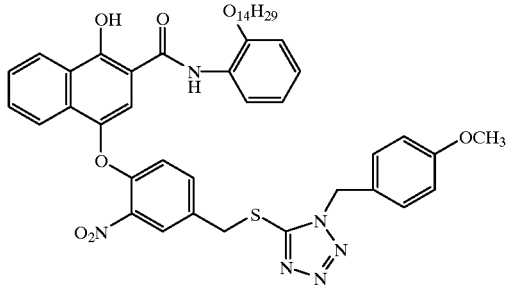

C-3:

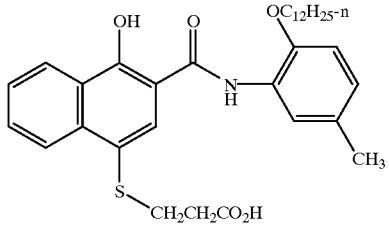

ILS-1:

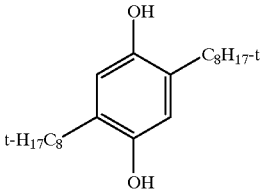

-continued

CH-1:
(4.22)

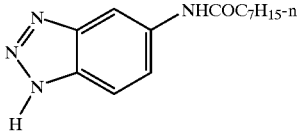

Samples of each element were given a stepped exposure and processed in the KODAK FLEXICOLOR (C41) process as described in *British Journal of Photography Annual*, 1988, pp196–198. Contrast of the elements was determined using the maximum slope between any two density points. Relative red sensitivity, a measure of speed, was determined by measuring the speed point +0.15 density units above Dmin and normalizing to the check position. Results are shown in Table I.

TABLE I

Use of Nitrogen Heterocycles in Antihalation Layers - Bilayer Format

| Sample | Comp/ Inv | Additive | Red Dmin | Contrast | Relative Red Sensitivity | ClogP |
|---|---|---|---|---|---|---|
| BL-1 | Comp | None | 0.210 | 1.11 | 1.00 | |
| BL-2 | Comp | ILS-1 | 0.150 | 1.11 | 1.02 | |
| BL-3 | Comp | CH-1 | 0.124 | 1.08 | 0.90 | 4.22 |
| BL-4 | Inv | H-A | 0.129 | 1.07 | 1.01 | 7.78 |
| BL-5 | Inv | H-A + ILS-1 | 0.105 | 1.08 | 1.02 | 7.78 |
| BL-6 | Inv | H-T | 0.183 | 1.12 | 1.01 | 11.25 |
| BL-7 | Inv | H-U | 0.116 | 0.96 | 0.99 | 4.80 |
| BL-8 | Inv | H-U + ILS-1 | 0.092 | 0.91 | 0.99 | 4.80 |

Sample BL-2 shows the effect of adding a hydroquinone scavenger for oxidized developer to the antihalation layer, a common method for removing unwanted oxidized developer. However, this alternative is not as effective at lowering red Dmin as are the compounds of the invention. BL-3 demonstrates that the ClogP must be sufficiently high to prevent wandering of the heterocycle into imaging layers and causing losses in light sensitivity. This sample achieves reduction in Dmin but exhibits an undesired reduction in Relative Red Sensitivity at the same time. Samples BL-4 to BL-8 show that the compounds of the invention are useful for controlling the Dmin of adjacent layers without significantly affecting their light sensitivity. Samples BL-5 and BL-8 show that the combination of the inventive materials with an oxidized developer scavenger is even more effective.

B—Yellow Filter Layer:

In order to show the effect of the inventive materials in yellow filter layers containing Carey-Lea colloidal silver, four-layer photographic elements were prepared by coating the following layers on a cellulose triacetate film support containing a sublayer of 2.41 gelatin and 0.344 grey colloidal silver (all coverages are in g/m$^2$). The coatings were exposed to blue and green light and processed as previously described. Results are shown in Table II.

Layer 1 (Magenta Layer): 2.69 Gelatin, 0.0448 M-1, 0.0027 M-2 and 0.699 green sensitized AgIBr tabular emulsion.

Layer 2 (Yellow Filter Layer): 0.645 Gelatin and ILS-1 (when present) at 0.086, ILS-2 (when present) at 0.054, H-A (when present) at 0.005, YFD-1 (when present) at 0.108 or Carey-Lea silver (when present) at 0.059.

Layer 3 (Yellow Layer): 2.69 Gelatin, 0.968 Y-1, 0.054 Y-2 and 0.699 blue sensitized AgIBr tabular emulsion.

Layer 4 (Overcoat): 2.69 Gelatin and 0.018 bis-vinylsulfonemethylether.

The structures of the couplers and comparative materials used, along with the corresponding ClogP where appropriate, in the above format are as follows:

M-1:

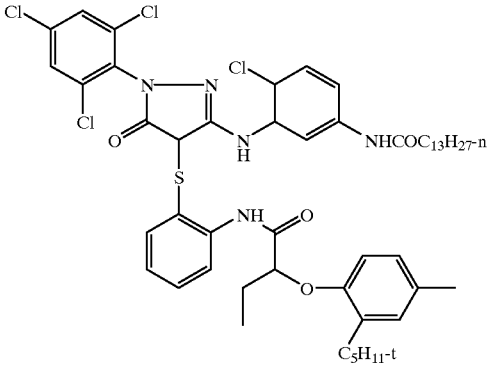

M-2:

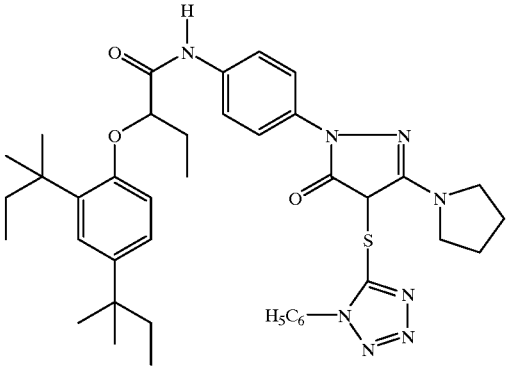

ILS-2:

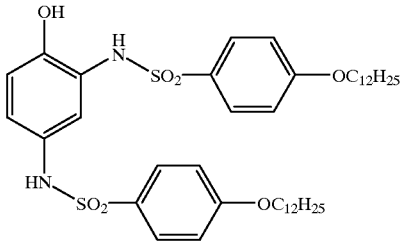

Y-1:

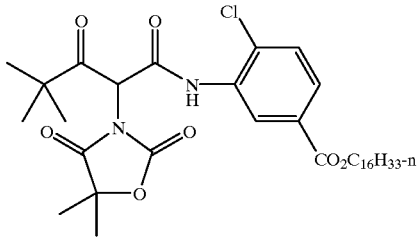

-continued

Y-2:

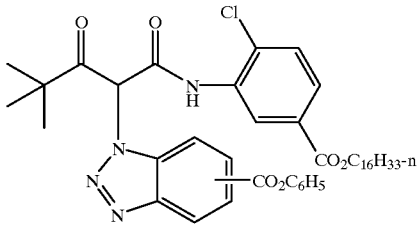

YFD-1:

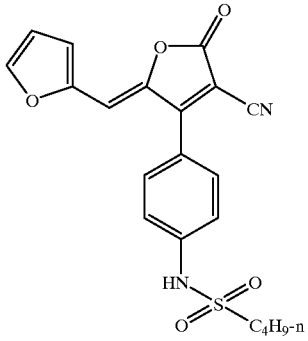

TABLE II

Use of Nitrogen Heterocycles in Yellow Filter Layers - Four Layer Format

| Sample | Comp/Inv | Yellow Filter Material | Additive | Blue Dmin | Green Dmin |
|---|---|---|---|---|---|
| FL-1 | Comp | YFD-1 | ILS-1 | 0.200 | 0.356 |
| FL-2 | Comp | YFD-1 | ILS-1 + H-A | 0.200 | 0.356 |
| FL-3 | Comp | YFD-1 | ILS-2 | 0.203 | 0.353 |
| FL-4 | Comp | YFD-1 | ILS-2 + H-A | 0.203 | 0.358 |
| FL-5 | Comp | Carey-Lea Ag | ILS-1 | 0.229 | 0.409 |
| FL-6 | Comp | Carey-Lea Ag | ILS-2 | 0.249 | 0.403 |
| FL-7 | Inv | Carey-Lea Ag | ILS-1 + H-A | 0.224 | 0.390 |
| FL-8 | Inv | Carey-Lea Ag | ILS-2 + H-A | 0.239 | 0.387 |

Comparison of samples FL-5 and FL-6 with FL-1 and FL-3 show that the presence of Carey-Lea colloidal elemental silver in place of organic yellow filter dye YFD-1 results in an increase in the Dmin of adjacent imaging layers. Addition of H-A to filter dye containing layers (FL-2 and FL-4) does not affect Dmin in adjacent layers. Only when the inventive heterocycle and elemental silver are present in the same layer are the adjacent Dmins reduced.

C—Multilayer Photographic Examples

The invention can be further illustrated in the following multilayer experiments. Component laydowns are provided in units of gm/sq m.

Layer A (Protective Overcoat Layer).

Layer B (UV Filter Layer)

Blue Sensitized Layer

Layer C (Yellow filter layer): ILS-1 at 0.054 and gelatin at 0.807. ps Green Sensitized Layer Layer D (Interlayer): ILS-1 at 0.075 and gelatin at 0538.

Red Sensitized Layer

Layer E (Interlayer): gelatin at 0.538 and ILS-1 at 0.076.

Layer F (Antihalation layer): gelatin at 1.61 and UV-1 and UV-2 both at 0.076.

Bislvinylsulfonyl)methane hardener was added at 1.55% of total gelatin weight. Antifoggants (including 4-hydroxy-6-methyl-1,3,3a,7-tetraazaindene), surfactants, coating aids, coupler solvents, emulsion addenda, sequestrants, lubricants, matte and tinting dyes were added to the appropriate layers as is common in the art. The structures of the additional compounds used in the multilayer examples are as follows.

Multilayer examples ML-1 to 8 which all employ the same basic formula with variations in the AHU with and without an interlayer are summarized in Table III. Samples of each element were given a stepped exposure and processed in the KODAK FLEXICOLOR (C-41) process as described in *British Journal of Photography Annual*, 1988, pp 196–198.

TABLE III

Multilayer Formulation Variations in AHU and Red Dmins

| Example | Comp/Inv | Layer E (IL) | Layer F (AHU) | Red Dmin |
|---|---|---|---|---|
| ML-1 | Comp | Present | +BCS (0.15)* | 0.207 |
| ML-2 | Comp | Omit | " | 0.309 |
| M1-3 | Comp | Omit | Omit BCS* | 0.197 |
| ML-4 | Cqmp | Omit | BCS (0.15)* | 0.213 |
| ML-5 | Inv | Omit | BCS (0.15)* + H-A(0.024) | 0.236 |
| ML-6 | Inv | Omit | BCS (0.15)* + H-A (0.024) | 0.171 |
| ML-7 | Inv | Omit | BCS (0.15)* + H-A (0.012) | 0.254 |
| ML-8 | Inv | Omit | BCS (0.15)* + H-A (0.024) + ILS-1 (0.162) | 0.212 |

*BCS = Black Colloidal Silver

Variability of Dmin within a multilayer film is very undesirable. While addition of an interlayer (layer E) between the AHU and imaging layers does decrease red Dmin, it requires an undesirable increase in film thickness as well as an additional layer. As demonstrated by examples ML-2 and ML-3, black colloidal silver (BCS) in the AHU Layer plays a significant role in causing increased red Dmin. Comparison of examples ML-2 and ML-4 shown that red Dmin is further increased when a bleach accelerating releasing coupler (C-3) is present. The addition of the inventive materials like H-A to the AHU layer containing black colloidal silver gave low red Dmin even when the protective interlayer was omitted (Examples ML-6 and ML-4). In addition, materials like H-A were also particularly effective at lowering red Dmin even when a bleach accelerating releasing coupler like C-3 was present in the film element (Examples ML-5 and ML-2). Multilayer Example ML-8 relative to ML-5 shows that compounds like ILS-1 in combination with H-A further improves control of red Dmin.

Multilayer examples ML-9 to ML-13 (with layer E present and with 0.15 black collodial silver in layer F) were prepared, exposed and processed as above to demonstrate the utility of the inventive compounds to reduce increases in Dmin caused by the use of yellow collodial silver (Carey-Lea silver) in the yellow filter layer (YFL). Results are shown in Table IV.

TABLE IV

Multilayer Formulation Variations in YFL and Blue or Green Dmins

| Example | Comp/Inv | Layer C (YFL) | Blue Dmin | Green Dmin |
|---|---|---|---|---|
| ML-9 | Comp | YFD-1 | 0.723 | 0.608 |
| ML-10 | Comp | CLS (0.065)* | 0.813 | 0.650 |
| ML-11 | Comp | CLS (0.065)* | 0.872 | 0.651 |
| ML-12 | Inv | CLS (0.065)* + H-A (0.024) | 0.739 | 0.622 |
| ML-12 | Inv | CLS (0.065)* + H-A (0.024) | 0.799 | 0.616 |

*CLS = Carey-Lea Silver

Comparison of ML-10 to ML-9 demonstrates that CLS in the YFL promotes Dmin increases in neighboring color records relative to dye (YFD-1) where there are no solution physical development effects. The presence of bleach accelerator releasing couplers further increases Dmin (ML-11). Addition of H-A to the YFL containing CLS significantly prevents these Dmin increases.

The element of the invention results not only in lower Dmin and fog in adjacent imaging layers but also causes reduced processing variability in the trade.

Quad-Coating

One embodiment of the invention is the use of a color record that is divided into at least four separate layers that are all sensitive to the same color but differ in the degree of sensitivity in conjunction with a non-imaging layer containing elemental silver and the heterocycle as described. Typically, the most sensitive layer will be closest to the source of exposure and the least sensitive layer furthest away, although other arrangements are possible. It is highly desirable that the non-imaging layer be located directly adjacent to one of the four imaging layers. In the case of where the non-imaging layer is an antihalation layer containing black colloidal silver, the most desirable adjacent imaging layer is the least sensitive red layer. In the case where the non-imaging layer is a yellow filter layer containing Carey-Lea silver, the most desirable adjacent imaging layer can be the least sensitive blue layer or the most sensitive green layer. It is preferred that the color record is divided into four separate records.

In order to minimize granularity and maintain contrast, Dmin and other important photographic properties when a color record is divided into four layers, it is generally desirable to control the degree of coupler starvation in each of the layers. Thus, it is preferred that the two most light sensitive layers each contain a molar ratio of total imaging materials to silver in the range of 0.005 to 0.15; and that in the two less light sensitive layers, a range of 0.10 to 0.40. It is also preferred to use two equivalent couplers, particularly in the most light sensitive layer, or mixtures of two and four equivalent couplers. Any known inhibitor releasing couplers alone or in combination can be used in any individual layer, but it is generally most useful to use couplers that release weak or more diffusible inhibitor fragments or contain a timing group to delay inhibitor release in at least one of the two most light sensitive layers. Any known masking couplers alone or in combination can be used in any individual layer as well.

One particular useful embodiment of the invention is when the red record is divided into four layers of different red sensitivity and the non-imaging layer is an antihalation layer containing black colloidal silver, particularly when the least sensitive red layer is directly adjacent to the antihalation layer. This is because the compounds of the invention allow for low red Dmin without requiring an interlayer and thus, four red layers can be used without an increase in the total number of layers in the full photographic element as compared to three red layers with an interlayer. Because in general more silver is used in a four layer record than a three layer record, removal of the silver after development is critical. It is highly desirable to use any of the materials known to accelerate silver bleaching or fixing in at least one of the four layers. In particular, it is desirable to use any of the known bleach accelerators (imagewise or non-imagewise) in at least one of the two least sensitive red layers at a laydown of at least 0.005 mmol/$m^2$ or more preferably, at least 0.01 mmol/$m^2$. Because of the high silver, retained sensitizing dye stain after processing can be a concern in this embodiment. This problem can be minimized by restricting the total amount of red sensitized silver coated to less than 4.0 g/$m^2$. It is also desirable to control such stain by appropriate choice of sensitizing dyes that leave minimal stain.

Some examples of image couplers, inhibitor releasing couplers and red sensitizing dyes that are particularly useful in a four layer red record are as follows:

C-5:

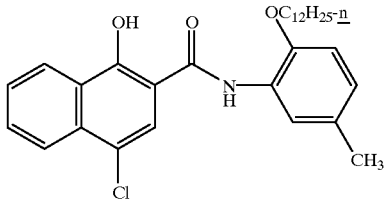

C-6:

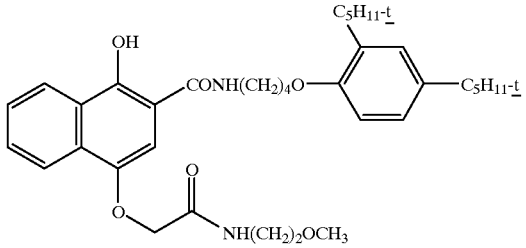

C-7:

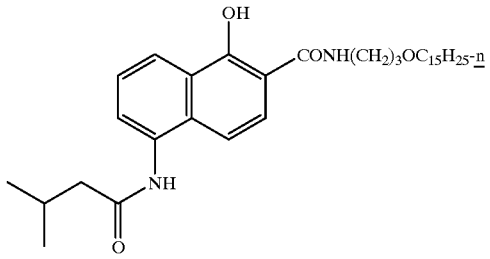

C-8:

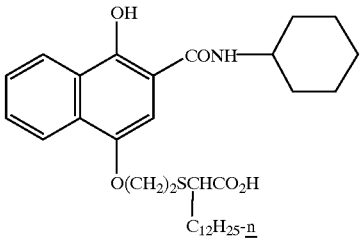

C-9:

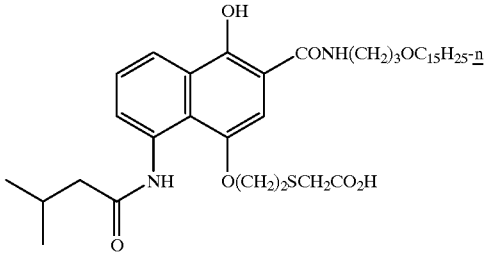

-continued
C-10:
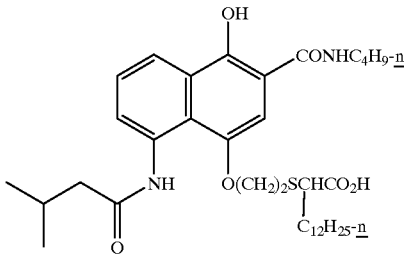
C-11:
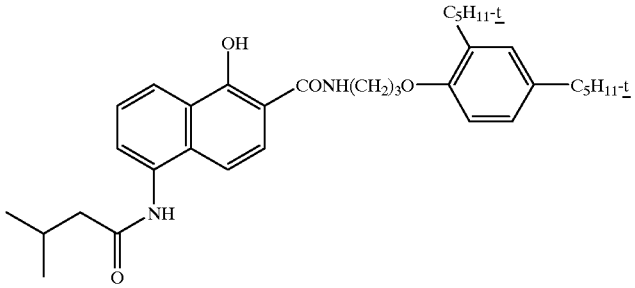
C-12:
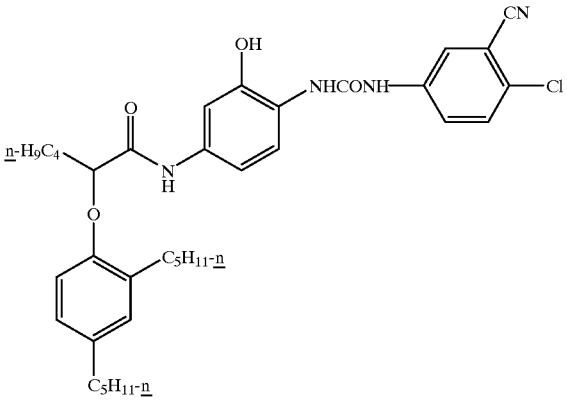
C-13:
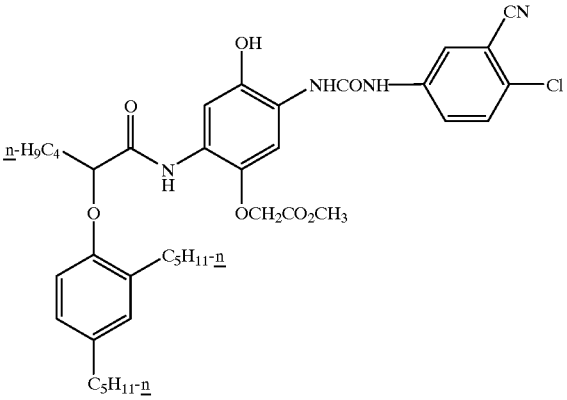

-continued
CDIR-4:
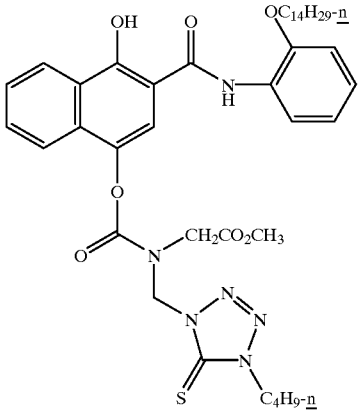
CDIR-5:
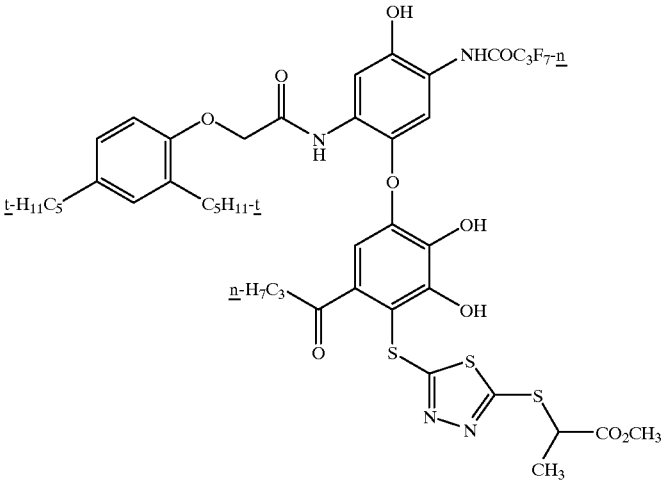
CDIR-6:
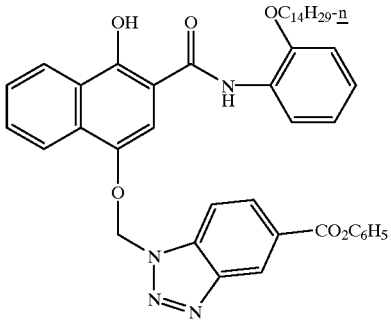

-continued
MC-3:
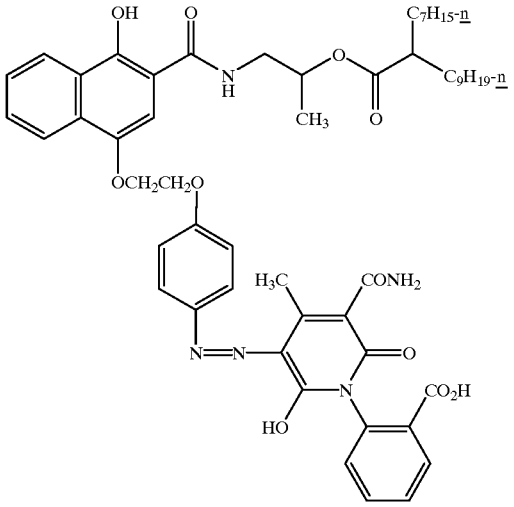
RSD-3:
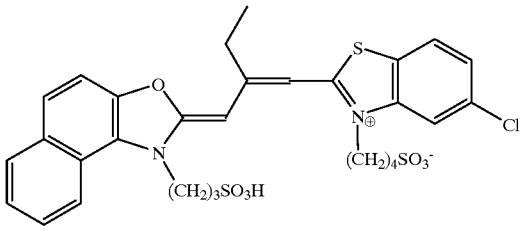
RSD-4:
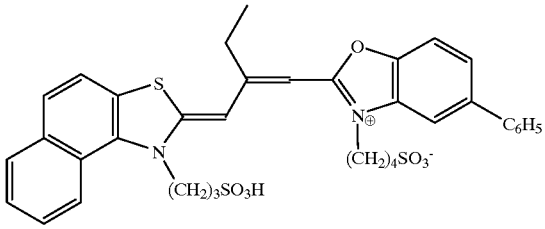
RSD-5:
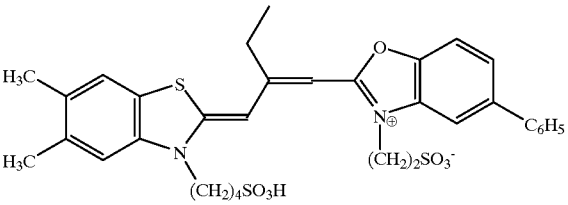
RSD-6:
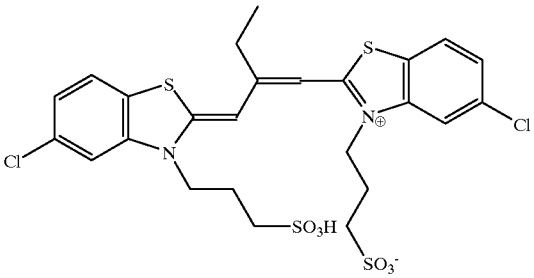

-continued

RSD-7:

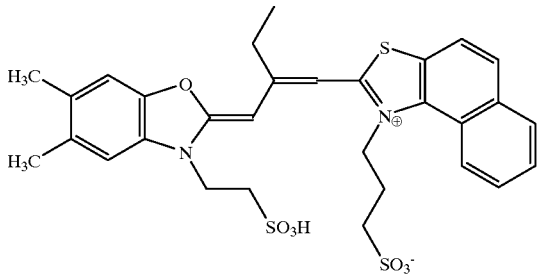

Example D

Full multilayer films demonstrating the principles of this invention were produced by coating the following layers on a cellulose triacetate film support (coverage are in grams per meter squared, emulsion sizes as determined by the disc centrifuge method and are reported in Diameter×Thickness in microns).

Example ML-13:

Layer 1 (Antihalation layer): black colloidal silver sol at 0.15; ILS-1 at 0.097, DYE-1 at 0.034; DYE-2 at 0.014; DYE-3 at 0.067; UV-1 and UV-2 (1:1) at a total of 0.075; thickener POL-1 at 0.011 and gelatin at 1.61.

Layer 2 (Interlayer): ILS-1 at 0.075 and gelatin at 0.538.

Layer 3 (Slowest cyan layer): a blend of two red sensitized (both with a mixture of RSD-1 and RSD-2) tabular silver iodobromide emulsions: (i) 0.77×0.099, 4.5 mole % I at 0.513 (ii) 0.60×0.12, 1.5 mole % I at 0.122; C-1 at 0.236; C-4 at 0.226; DIR coupler C-2 at 0.032; bleach accelerator releasing coupler C-3 at 0.086 and gelatin at 1.65.

Layer 4 (Slow cyan layer): a red sensitized (same as above) tabular silver iodobromide emulsion (1.33×0.125, 3.7 mole % I) at 0.531; C-1 at 0.236; C-4 at 0.076; masking coupler MC-1 at 0.022; CDIR-2 at 0.043; C-3 at 0.011; and gelatin at 1.00.

Layer 5 (Mid cyan layer): a red sensitized (sensitized with a mixture of RSD-1, RSD-2 and RSD-3) tabular silver iodobromide emulsion (2.20×0.13, 3.7 mole % I) at 1.038; C-1 at 0.188; CDIR-2 at 0.054; C-3 at 0.075; POL-1 at 0.072 and gelatin at 1.00.

Layer 6 (Fast cyan layer): a red sensitized (same as in Layer 5) tabular silver iodobromide emulsion (3.5×0.13, 3.7% I) at 1.27; C-4 at 0.16; CDIR-3 at 0.022; CDIR-4 at 0.040; ILS-1 at 0.014; POL-1 at 0.079 and gelatin at 1.123.

Layer 7 (Interlayer): ILS-1 at 0.075 and gelatin at 0.538.

Layer 8 (Slow magenta layer): a blend of two green sensitized (both with a mixture of GSD-1 and GSD-2) silver iodobromide emulsions: (i) 0.97×0.125, 4.5 mole % iodide at 0.152 and (ii) 0.60×0.120, 1.5 mole % iodide at 0.400; magenta dye forming coupler M-1 at 0.376; MC-2 at 0.090; IDIR-1 at 0.032; ILS-1 at 0.011; POL-1 at 0.050 and gelatin at 1.25.

Layer 9 (Mid magenta layer): a blend of two green sensitized (same as above) tabular silver iodobromide emulsions (i) 2.20×0.115, 3.7 mole % I at 0.513 and (ii) 1.40×0.115, 3.7 mole % I at 0.406; M-1 at 0.088; MC-2 at 0.086; IDIR-1 at 0.025; ILS-1 at 0.013; and gelatin at 1.453.

Layer 10 (Fast magenta layer): a green sensitized tabular silver iodobromide (2.90 ×0.13, 3.7 mole % I) emulsion at 1.24; M-1 at 0.108; MC-2 at 0.0215; IDIR-1 at 0.011; M-2 at 0.0027, ILS-1 at 0.0162 and gelatin at 1.529.

Layer 11 (Interlayer): ILS-1 at 0.182; and gelatin at 0.538.

Layer 12 (Slow yellow layer): a blend of three blue sensitized (all with a mixture of BSD-1 and BSD-2) tabular silver iodobromide emulsions (i) 1.95×0.135, 2 mole % I at 0.500 (ii) 0.0.97×0.135, 2.0 mole % I at 0.104 and (iii) 0.60×0.12, 2 mole % I at 0.485; Y-1 at 0.900; Y-2 at 0.038; C-2 at 0.022; C-3 at 0.0086; POL-1 at 0.018 and gelatin at 2.00.

Layer 13 (Fast yellow layer): a blend of two blue sensitized silver iodobromide emulsions (i) a 3D emulsion (sensitized with BSD-1, average diameter of 1.23, 9.7 mole % I) at 0.922 and (ii) a tabular emulsion (sensitized with BSD-1 and BSD-2, 3.75×0.135, 3.7 mole % I) at 0.300; Y-1 at 0.358; Y-2 at 0.065; C-3 at 0.011; addenda A-1 at 0.0086 and gelatin at 1.360.

Layer 14 (UV filter layer): silver bromide Lippmann emulsion at 0.215; UV-1 and UV-2 (1:1) at a total of 0.108 and gelatin at 0.700.

Layer 15 (Protective overcoat): gelatin at 0.888.

Surfactants, coating aids, emulsion addenda, sequestrants, thickeners, lubricants, matte and tinting dyes and bis (vinylsulfonyl)methane hardener were added to the appropriate layers as is common in the art. Structures of the materials used in this multilayer format are as follows:

DYE-1:
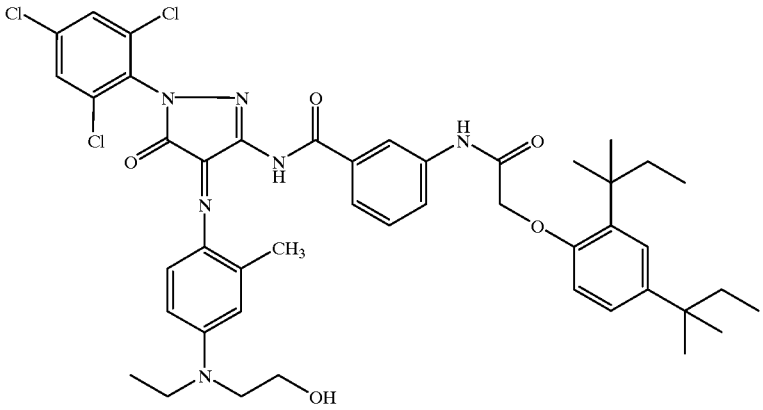
DYE-2:
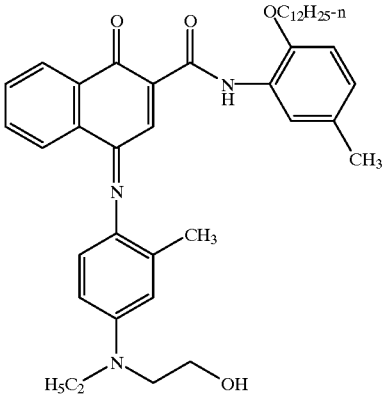
DYE-3:
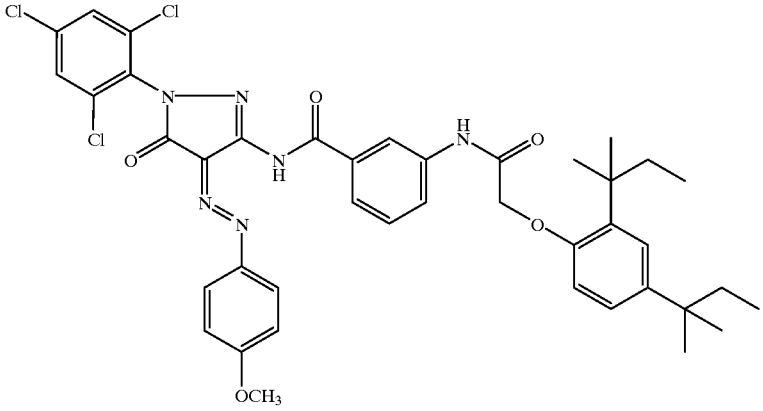
UV-1:
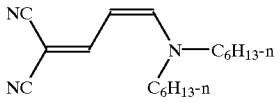
UV-2:
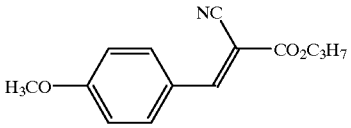

-continued
C-4:
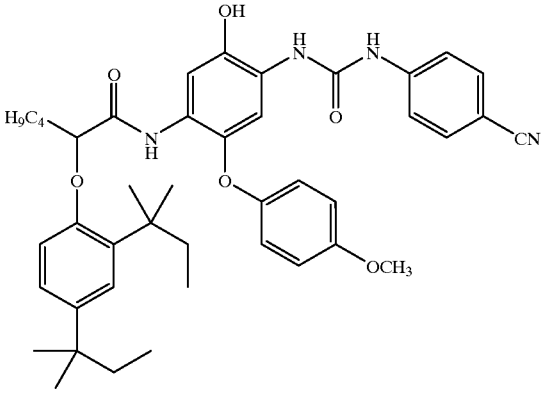
MC-1:
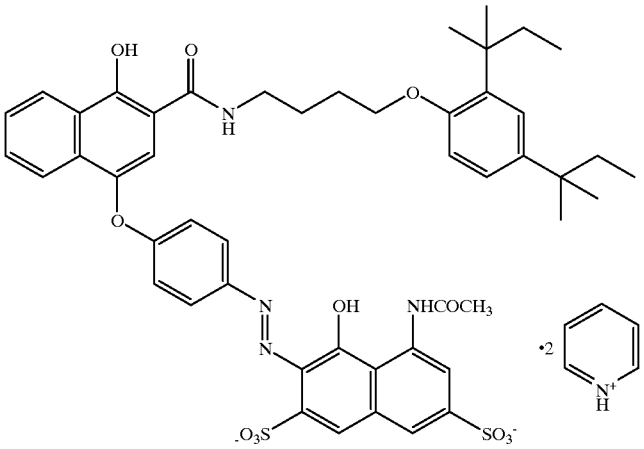
CDIR-2:
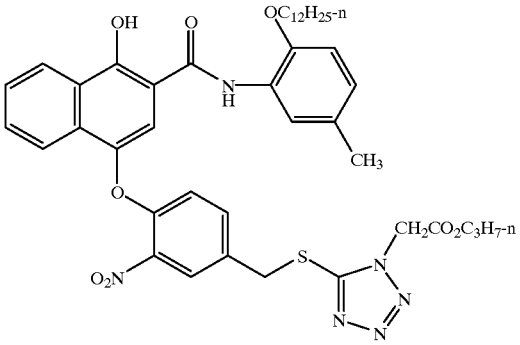
CDIR-3:
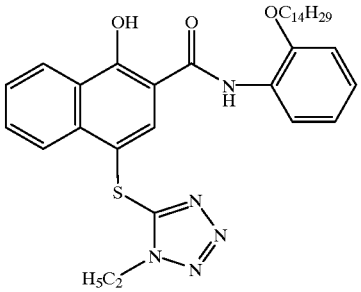

-continued
MC-2:
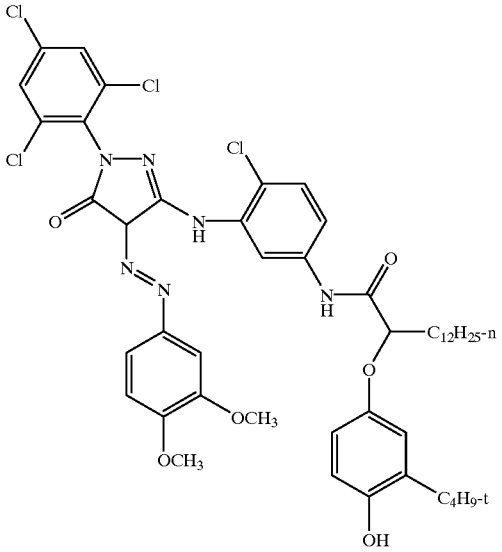
IDIR-3:
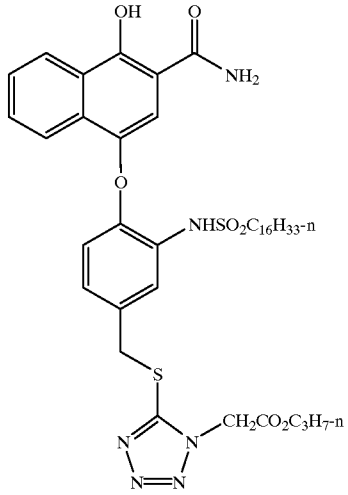
A-1:
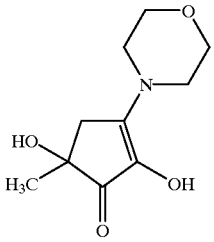
POL-1:
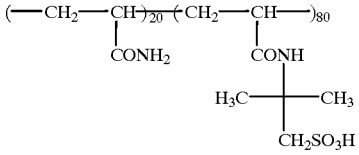
RSD-1:
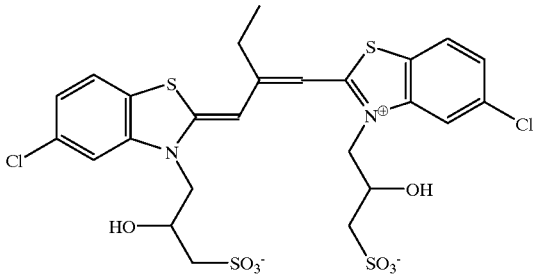

-continued
RSD-2:
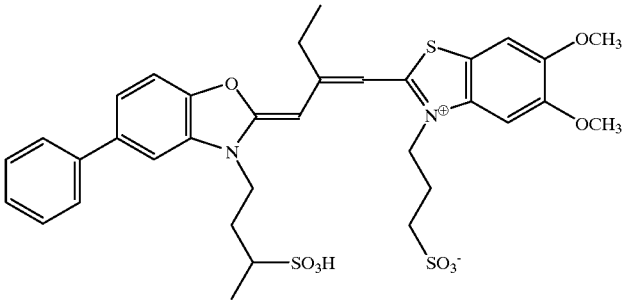
RSD-3:
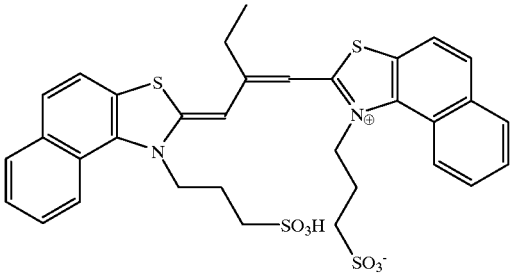
GSD-1:
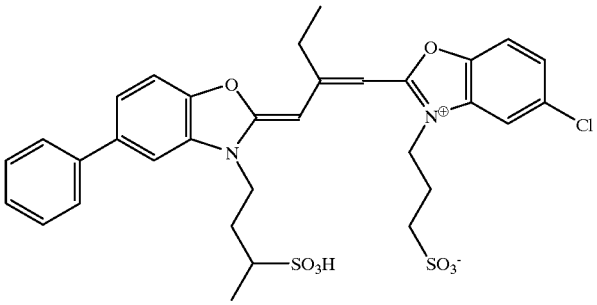
GSD-2:
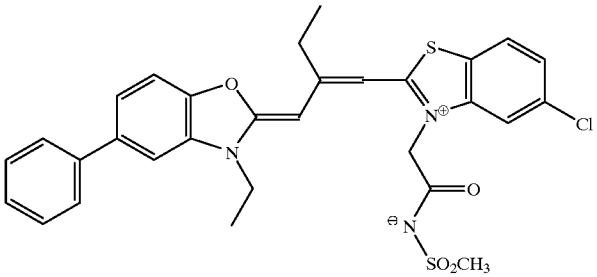
BSD-1:
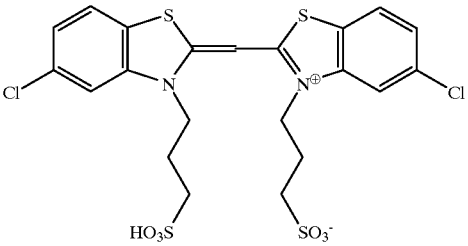
BSD-2:
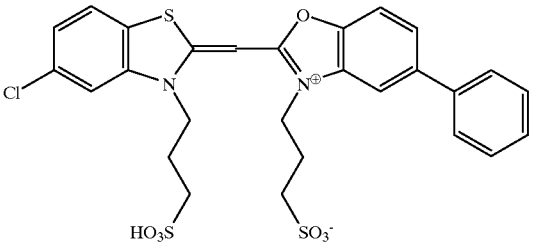

-continued

H-AC

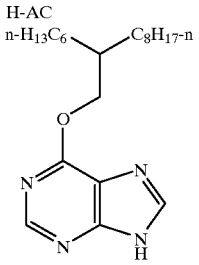

Sample ML-14 was prepared like ML-13 except that 0.043 of inventive heterocycle H-AC (ClogP=7.84; dispersed in twice its weight in N,N-dibutyllauramide) was added to Layer 1. Sample ML-15 was like ML-13 except that Layer 2 was omitted. Sample ML-16 was like ML-14 except that Layer 2 was omitted. These multilayer coatings were given a stepped exposure and processed in C41 as previously described . Results are shown in Table V.

TABLE V

Red Dmin in Full Multilayer Format

| Sample | Comp/Inv | H-AC in Layer 1? | Layer 2 Present? | Red Dmin |
|---|---|---|---|---|
| ML-13 | Comp | No | Yes | 0.300 |
| ML-14 | Inv | Yes | Yes | 0.287 |
| ML-15 | Comp | No | No | 0.359 |
| ML-16 | Inv | Yes | No | 0.295 |

The results in TABLE V clearly demonstrate a decrease in the Dmin of the layers above the antihalation layer (Layer 1) whenever a heterocycle of the invention is present. While the addition of an interlayer (Layer 2) does lower the Dmin somewhat (compare ML-13to ML-15), the addition of a compound of the invention to the antihalation layer causes a further improvement (compare ML-14 to ML-13). An even larger improvement is found without the interlayer present (compare ML-16 to ML-15). Even an AHU layer with the compound of the invention and without the extra interlayer represents a superior Dmin position relative to an interlayer alone (compare ML-16 to ML-13).

The invention has been described in detail with particular reference to preferred embodiments thereof but it will be understood that variations and modifications can be effected within the scope and spirit of the invention.

What is claimed is:

1. A silver halide color photographic element comprising a non-light sensitive layer containing elemental silver and a nitrogen heterocycle compound having a ClogP of at least 4.5, which compound comprises a ring system of one or more fused rings containing at least one —N—H bond, the ring system comprising a total of at least three nitrogen ring members and the associated bonds; provided that the compound does not contain an —SH group or >C=S group and does not react with an oxidized developer.

2. The color photographic element of claim 1 wherein the nitrogen heterocycle is a benzotriazole.

3. The color photographic element of claim 1 wherein the nitrogen heterocycle is a 1,2,3-triazole.

4. The color photographic element of claim 1 wherein the nitrogen heterocycle is a 1,2,4-triazole.

5. The color photographic element of claim 1 wherein the nitrogen heterocycle is a purine.

6. The color photographic element of claim 1 where the ClogP of the nitrogen heterocycle is at least 5.5.

7. The color photographic element of claim 1 where the elemental silver is colloidal silver and is neutral in color.

8. The color photographic element of claim 1 where the elemental silver is colloidal silver and is yellow in color.

9. The color photographic element of claim 1 where the nitrogen heterocycle is selected from the following compounds:

H-A:

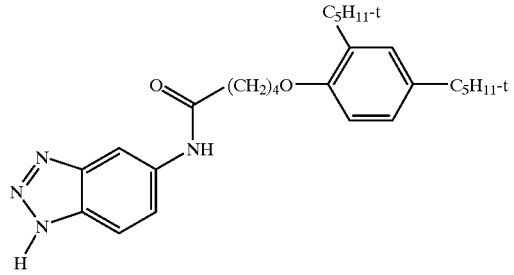

H-B:

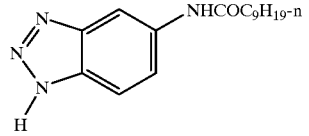

H-C:

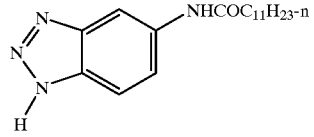

H-D:

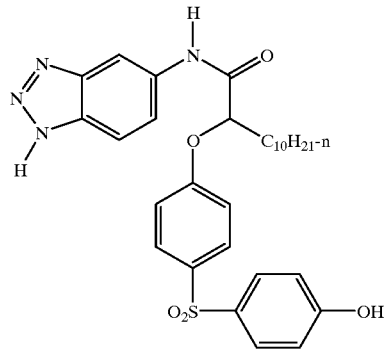

-continued
H-E:
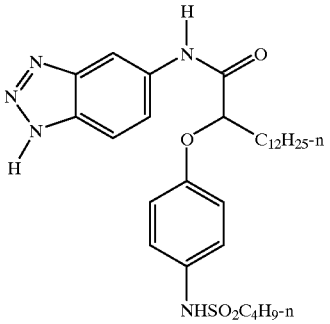
H-F:
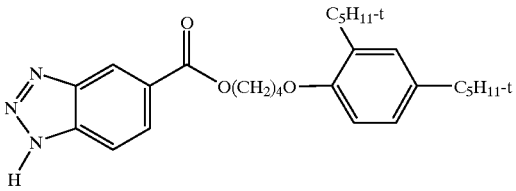
H-G:
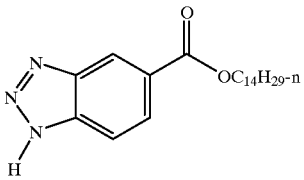
H-H:
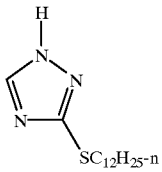
H-I:
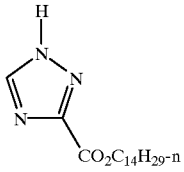
H-J:
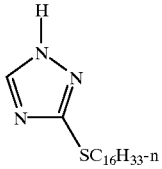
H-K:
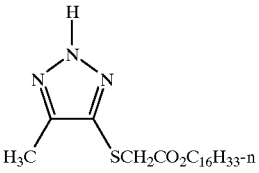
-continued
H-L:
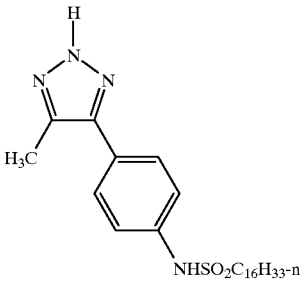
H-M:
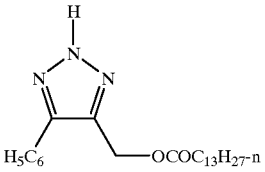
H-N:
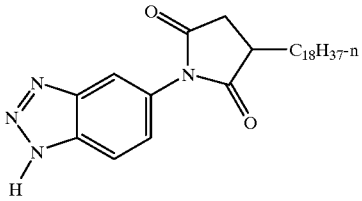
H-O:
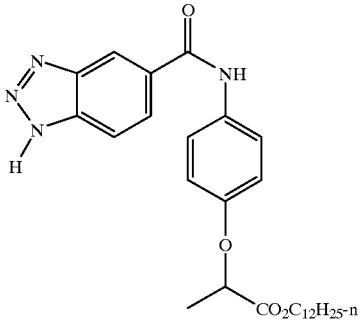
H-P:
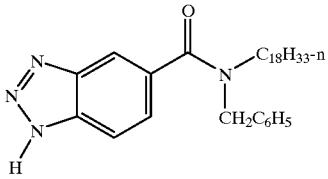
H-Q:
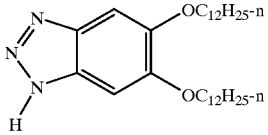
H-R:
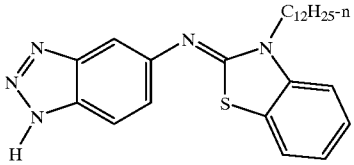

-continued

H-S:

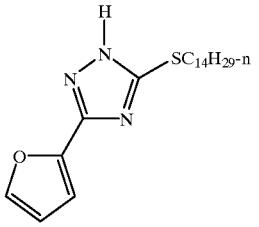

H-T:

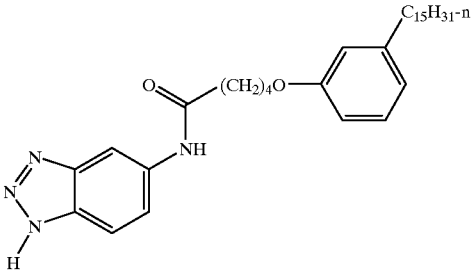

H-U:

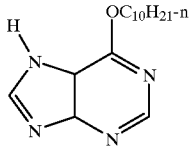

10. The color photographic element of claim 1 where the nitrogen heterocycle is selected from the following compounds:

H-A:

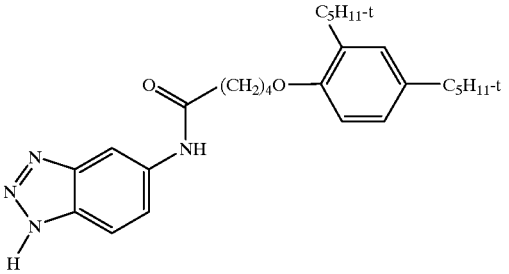

H-T:

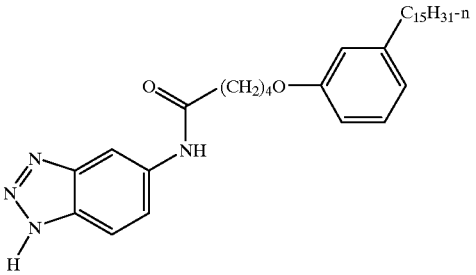

H-U:

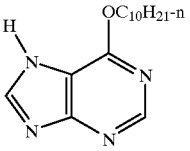

-continued

H-AC

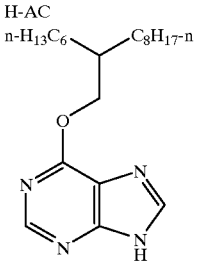

11. The element of claim 1 wherein the layer containing the nitrogen heterocycle compound also contains an interlayer scavenger.

12. The element of claim 11 wherein the interlayer scavenger is a hydroquinone compound.

13. The color photographic element of claim 1 wherein the nitrogen heterocycle is a tetraazaindene.

14. The element of claim 1 wherein the nitrogen herocycle compound is dispersed in a hydrophobic organic medium.

15. The element of claim 14 wherein the hydrophobic organic medium is selected from the group consisting of tricresylphosphate, N,N-diethyllauramide, N,N'-dibutyllauramide, p-dodecylphenol, dibutylpthalate, di-n-butyl sebacate, N-n-butylacetanilide, 9-octadec-en-1-ol, trioctylamine and 2-ethylhexylphosphate.

16. The element of claim 11 wherein the nitrogen heterocycle compound is dispersed in a hydrophobic organic solvent.

17. The element of claim 1 wherein the nitrogen heterocycle is a tetrazole.

18. The color photographic element of claim 1 which additionally contains in a non-light sensitive layer at least one bleach accelerator releasing material.

19. The color photographic element of claim 6 which additionally contains at least one bleach accelerator releasing material.

20. The color photographic element of claim 7 which contains in a red light sensitive imaging layer at least one bleach accelerator releasing material.

21. The element of claim 1 wherein the non-light sensitive layer containing elemental silver is an antihalation layer containing black colloidal silver and is adjacent to a light sensitive silver halide layer.

22. The element of claim 1 wherein the non-light sensitive layer containing elemental silver is a yellow filter layer containing Carey-Lea Silver and is located between two light sensitive silver halide emulsion layers.

23. The color photographic element of claim 1 comprising blue, green or red color records in which at least one of is divided into at least 4 silver halide emulsion layers of different relative sensitivity to the same color light.

24. The color photographic element of claim 23 in which the red color record is divided into 4 layers of different relative sensitivity to red light.

25. The color photographic element of claim 24 in which the least sensitive of the red light sensitive layers is adjacent to an antihalation layer.

* * * * *